US009730503B2

(12) United States Patent
Moon

(10) Patent No.: US 9,730,503 B2
(45) Date of Patent: Aug. 15, 2017

(54) TOOL FOR APPLYING COSMETICS TO EYELASH

(71) Applicant: INTERWORK KOREA CO., LTD., Siheung-si (KR)

(72) Inventor: Hyun Myung Moon, Yongin (KR)

(73) Assignee: INTERWORK KOREA CO., LTD., Siheung-si (KR)

( * ) Notice: Subject to any disclaimer, the term of this patent is extended or adjusted under 35 U.S.C. 154(b) by 0 days.

(21) Appl. No.: 15/185,589

(22) Filed: Jun. 17, 2016

(65) Prior Publication Data

US 2016/0316888 A1 Nov. 3, 2016

(30) Foreign Application Priority Data

Apr. 29, 2015 (KR) ..... 10-2015-0060692

(51) Int. Cl.
*A45D 40/26* (2006.01)
*A46B 5/00* (2006.01)

(52) U.S. Cl.
CPC ..... *A45D 40/265* (2013.01); *A46B 5/0012* (2013.01); *A46B 2200/1053* (2013.01)

(58) Field of Classification Search
CPC combination set(s) only.
See application file for complete search history.

(56) References Cited

U.S. PATENT DOCUMENTS 2,022,896 A * 12/1935 Nathans ..... A45D 2/48 15/106
5,007,442 A * 4/1991 Hirzel ..... A45D 2/48 132/120
5,052,839 A * 10/1991 Pettengill ..... A45D 40/265 401/10
5,176,156 A * 1/1993 Ashtary ..... A45D 40/26 132/217
5,435,611 A * 7/1995 Campbell ..... B25B 7/02 294/118
5,622,398 A * 4/1997 Duchaine, Jr. ..... B25B 9/00 29/278
8,851,775 B2 10/2014 Jacob
2014/0099152 A1 4/2014 Hatch

FOREIGN PATENT DOCUMENTS

KR 10-2007-0098424 10/2007
KR 10-0852725 8/2008
KR 10-1257730 4/2013

* cited by examiner

*Primary Examiner* — David Walczak
(74) *Attorney, Agent, or Firm* — Lex IP Meister, PLLC.

(57) ABSTRACT

A tool for applying cosmetics to an eyelash. The tool includes a container containing eyelash cosmetics; a lid coupled with the container; a first part of tongs disposed at the lid; a second part of tongs hinge-coupled to the first part of tongs and to approach the first part of tongs or separate from the first part of tongs; a knob installed at the first part of tongs to protrude out of the lid; a tightening ring surrounding the first part of tongs and the second part of tongs and to provide elastic force in a direction in which the first part of tongs and the second part of tongs approach each other; and a first brush and a second brush respectively coupled to an end portion of the first part of tongs and an end portion of the second part of tongs.

2 Claims, 4 Drawing Sheets

TOOL FOR APPLYING COSMETICS TO EYELASH

CROSS-REFERENCE TO RELATED APPLICATION

This application claims priority to and the benefit of Korean Patent Application No. 10-2015-0060692 filed in the Korean Intellectual Property Office on Apr. 29, 2015, the entire contents of which are incorporated herein by reference.

BACKGROUND OF THE INVENTION (a) Field of the Invention

The present invention relates to a tool for applying cosmetics to an eyelash.

(b) Description of the Related Art

Generally, a tool for applying cosmetics to an eyelash has been used. Such a tool for applying cosmetics to the eyelash is disclosed in U.S. Patent Laid-Open Publication No. US2014/0099152. According to U.S. Patent Laid-Open Publication No. US2014/0099152, a tongs type of tool for applying cosmetics to the eyelash is disposed in a container in which cosmetics for the eyelash are contained. A user takes the tool for applying cosmetics to the eyelash out of the container, and then applies the eyelash cosmetics to the eyelash by using the tongs.

However, in the case of U.S. Patent Laid-Open Publication No. US2014/0099152, since the tool for applying cosmetics is not perfectly combined with the container in which the eyelash cosmetics are contained, a seal state of the container is not stable, thus the eyelash cosmetics contained in the container may be hardened or oxidized such that they may not be used. Particularly, in the tool for applying cosmetics including the tongs as described above, external air may flow into the container through a gap between the tongs. Accordingly, when the external air flows in the container, the eyelash cosmetics in the container are hardened or deteriorate, thereby lowering marketability of the tool for applying cosmetics.

PRIOR ART DOCUMENT

Patent Document (Patent Document 1) U.S. Patent Laid-Open Publication No. US2014/0099152 (2014 Apr. 10.)

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a tool for applying cosmetics to an eyelash that may conveniently apply eyelash cosmetics to an eyelash by being formed to have a tongs type of structure and that may prevent the eyelash cosmetics contained in a container thereof from being hardened or deteriorating to improve marketability of the tool.

An exemplary embodiment of the present invention provides a tool for applying cosmetics to an eyelash, including: a container configured to contain eyelash cosmetics; a lid configured to be coupled with the container; a first part of tongs configured to be disposed at the lid; a second part of tongs configured to be hinge-coupled to the first part of tongs and to approach the first part of tongs or separate from the first part of tongs; a knob configured to be installed at the first part of tongs to protrude out of the lid; a tightening ring configured to surround the first part of tongs and the second part of tongs and to provide elastic force in a direction in which the first part of tongs and the second part of tongs approach each other; and a first brush and a second brush configured to be respectively coupled to an end portion of the first part of tongs and an end portion of the second part of tongs.

The tightening ring may include a first seal part configured to be disposed to surround the first part of tongs and the second part of tongs and to seal the container and external circumferential surfaces of the first part of tongs and the second part of tongs, and a second seal part configured to have a shape in which a central portion of the first seal part extends to seal the first part of tongs and the second part of tongs.

A first packing member may be provided on the container and a second packing member may be provided on the lid, wherein the second packing member may be closely attached to the first packing member to prevent the container from being blocked from the outside, and the first packing member may include a cylinder part disposed on some of an inner wall of an entrance of the container and a catching protrusion that extends from the cylinder part to be caught on an outer side of the entrance of the container and to be closely attached to the second packing member.

According to the embodiment of the present invention, it is possible to prevent the eyelash cosmetics contained in the container from being hardened or deteriorating by including the first and second parts of tongs for forming the tongs and the tightening ring for preventing the external air from flowing into the container between the first part of tongs and the second part of tongs. Thus, according to the exemplary embodiment of the present invention, it is possible to improve marketability of the tool for applying the cosmetics to the eyelash.

DETAILED DESCRIPTION OF THE EMBODIMENTS

Figure 1:
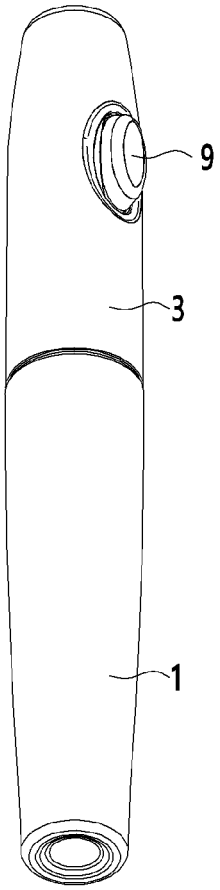
FIG. 1 illustrates a schematic perspective view of a tool for applying cosmetics to an eyelash according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
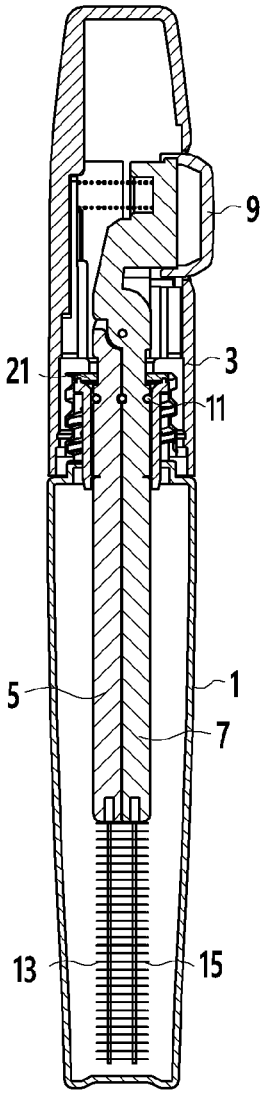
FIG. 2 illustrates a cross-sectional view of FIG. 1 with respect to a longitudinal direction.
Figure 3:
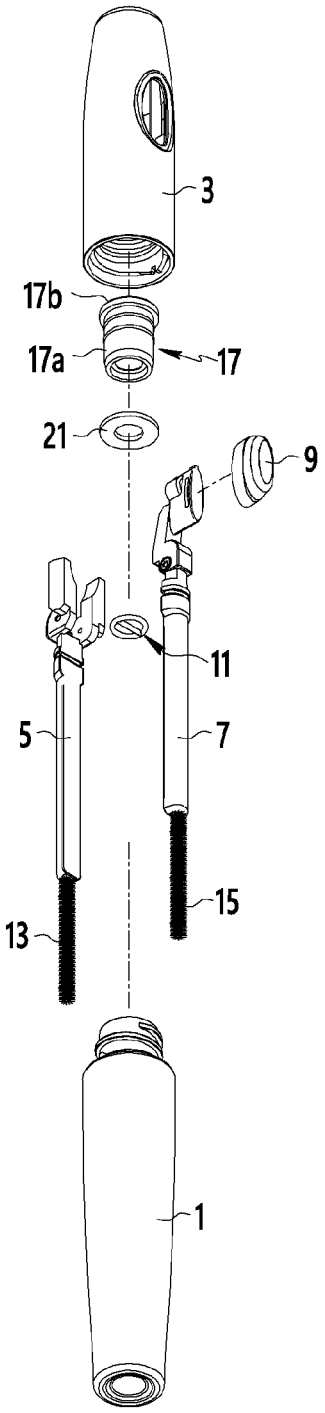
FIG. 3 illustrates an exploded perspective view of main parts of FIG. 1.

FIG. 1 illustrates a schematic perspective view of a tool for applying cosmetics to an eyelash according to an exemplary embodiment of the present invention, FIG. 2 illustrates a cross-sectional view of FIG. 1 with respect to a longitudinal direction, and FIG. 3 illustrates an exploded perspective view of main parts of FIG. 1.

A tool for applying cosmetics to an eyelash according to an exemplary embodiment of the present invention includes a container 1, a lid 3, a first part 5 of tongs, a second part 7 of tongs, a knob 9, a tightening ring 11, a first brush 13, and a second brush 15.

The container 1 may be formed with a relatively long keg shape to contain liquid cosmetics for the eyelash. Threads are provided on an external circumferential surface of an entrance of the container 1 to be engaged with the lid 3.

A first packing member 17 is disposed on the container 1. The first packing member 17 includes a cylinder part 17*a* and a catching protrusion 17*b*. The cylinder part 17*a* is formed to have a cylindrical shape and is disposed on an inner surface of the entrance of the container 1. The catching protrusion 17*b* extends from the cylinder part 17*a* and is formed to be caught on an outer side of the entrance of the container 1. The first packing member 17 may preferably be made of a rubber or silicon material.

Thread grooves corresponding to threads provided on the container 1 are provided on an interior circumferential surface of the lid 3. Thus, the lid 3 may be screw-coupled with and fastened on the container 1.

The first and second parts 5 and 7 of the tongs are hinge-coupled with each other, and portions thereof are disposed in the lid 3. That is, the first and second parts 5 and 7 of the tongs are hinge-coupled with each other, and the hinge-coupled portion may be coupled with the inside of the lid 3. Accordingly, one end of the first part 5 of tongs and one end of the second part 7 of tongs may approach each other or separate from each other.

The knob 9 may be provided at one side of the second part 7 of tongs, and it may protrude out of the lid 3. Thus, the user can press the knob 9 to increase an interval between the first part 5 of tongs and the second part 7 of tongs.

The first brush 13 is provided at an end portion of first part 5 of tongs. In addition, the second brush 15 is provided at an end portion of the second part 7 of tongs. Thus, the user can press the knob 9 to widen the interval between the first brush 13 and the second brush 15.

A second packing member 21 is disposed on external circumferential surfaces of the first part 5 of tongs and the second part 7 of tongs. The second packing member 21 is closely disposed on top of the catching protrusion 17*b* of the first packing member 17. Accordingly, the inside of the container 1 is sealed from the outside, such that it is possible to prevent the cosmetics in the container 1 from deteriorating.

Figure 4:
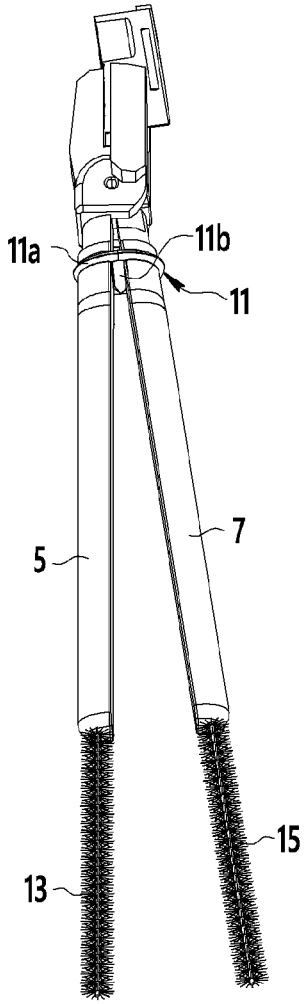
FIG. 4 illustrates a schematic view of main parts of a tool for applying cosmetics to an eyelash according to an exemplary embodiment of the present invention.

As shown in FIG. 4, the tightening ring 11 is disposed to surround the external circumferential surfaces the first part 5 of tongs and the second part 7 of tongs, and it may be made of an elastic material providing elastic force in a direction in which the first part 5 of tongs and the second part 7 of tongs approach each other. Alternatively, the tightening ring 11 may be made of a rubber or silicon material, or a synthetic resin material with excellent elastic force. The tightening ring 11 according to the exemplary embodiment of the present invention includes a first seal part 11*a* and a second seal part 11*b*.

The first seal part 11*a* is formed to have a ring shape and is disposed to surround the external circumferential surfaces of the first part 5 of tongs and the second part 7 of tongs. The first seal part 11*a* may be closely attached to an inner wall of the cylinder part 17*a* of the first packing member 17 of the container 1.

The second seal part 11*b* is formed to have a shape in which a central portion of the first seal part 11*a* of the circular shape is extended. The second seal part 11*b* is disposed between the first part 5 of tongs and the second part 7 of tongs. Accordingly, the second seal part 11*b* serves to block external air by sealing the first part 5 of tongs and the second part 7 of tongs.

Operations of the tool for applying cosmetics to the eyelash according to the exemplary embodiment of the present invention will now be described in detail.

First, the user rotates the lid 3 to separate the lid 3 from the container 1. When the lid 3 is drawn out of the container 1, the first brush 13 and the second brush 15 contain the eyelash cosmetics. In this state, when the user presses the knob 9, the first part 5 of tongs and the second part 7 of tongs overcome the elastic force of the first seal part 11*a* of the tightening ring 11, such that the interval between the first part 5 of tongs and the second part 7 of tongs is widened. While the interval between the first part 5 of tongs and the second part 7 of tongs is widened, the first brush 13 and the second brush 15 are also widely separated from each other.

Then, after the user positions her eyelash between the first brush 13 and the second brush 15, the user releases the pressed state of the knob 9. Therefore, the first brush 13 and the second brush 15 closely contact each other with her eyelash therebetween. In this state, the user combs her eyelash like combing her hair. Thus, the eyelash cosmetics contained on the first brush 13 and the second brush 15 are painted on her eyelash as eyelash makeup. In this case, according to movement of the user's hand, the user's eyelash may be curled. In the exemplary embodiment of the present invention, the first brush 13 and the second brush 15 may be used to apply makeup to an eyelash even in a state in which they are overlapped with each other.

When the eyelash makeup application is completed, the user rotates the lid 3 to be coupled with the container 1. Then, the first seal part 11*a* of the tightening ring 11 is closely attached to the cylinder part 17*a* of the first packing member 17 such that external air may be blocked. Simultaneously, the second seal part 11*b* seals the first part 5 of tongs and the second part 7 of tongs such that the external air may not flow into the container 1 between the first part 5 of tongs and the second part 7 of tongs.

According to the exemplary embodiment of the present invention, since the eyelash cosmetics contained in the container 1 do not contact the external air, the eyelash cosmetics may be stored for a long time, thereby improving marketability of the tool for applying the cosmetics to the eyelash.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1. container
3. lid
5. first part of tongs
7. second part of tongs
9. knob

11. tightening ring 11*a*. first seal part 11*b*. second seal part
13. first brush
15. second brush
17. first packing member
21. second packing member

What is claimed is:

1. A tool for applying cosmetics to an eyelash, comprising:

a container configured to contain eyelash cosmetics;

a lid configured to be coupled with the container;

a first part of tongs configured to be disposed at the lid;

a second part of tongs configured to be hinge-coupled to the first part of tongs and to approach the first part of tongs or separate from the first part of tongs;

a knob configured to be installed at the second part of tongs to protrude out of the lid;

a tightening ring configured to surround the first part of tongs and the second part of tongs and to provide elastic force in a direction in which the first part of tongs and the second part of tongs approach each other; and a first brush and a second brush configured to be respectively coupled to an end portion of the first part of tongs and an end portion of the second part of tongs, wherein the tightening ring includes a first seal part configured to be disposed to surround the first part of tongs and the second part of tongs and to seal the container and external circumferential surfaces of the first part of tongs and the second part of tongs, and a second seal part configured to have a shape in which a central portion of the first seal part extends to seal the first part of tongs and the second part of tongs.

2. The tool for applying the cosmetics to the eyelash of claim 1, wherein a first packing member is provided on the container and a second packing member is provided on the lid, wherein the second packing member is closely disposed on the first packing member, and the first packing member includes a cylinder part disposed on some of an inner wall of an entrance of the container, and a catching protrusion that extends from the cylinder part to be caught on an outer side of the entrance of the container and to be closely attached to the second packing member.

* * * * *